United States Patent [19]

Rossmo

[11] 4,334,617

[45] * Jun. 15, 1982

[54] MEDICATION DISPENSER

[76] Inventor: William Rossmo, 158 Mount Allison Crescent, Saskatoon, Saskatchewan, Canada

[ * ] Notice: The portion of the term of this patent subsequent to Jan. 20, 1998, has been disclaimed.

[21] Appl. No.: 195,960

[22] Filed: Oct. 10, 1980

Related U.S. Application Data

[63] Continuation of Ser. No. 29,428, Apr. 12, 1979, Pat. No. 4,245,742.

[30] Foreign Application Priority Data

Sep. 19, 1978 [CA] Canada ..... 311617

[51] Int. Cl.[3] ..... B65D 83/04

[52] U.S. Cl. ..... 206/534; 206/538; 206/533; 220/20.5

[58] Field of Search ..... 206/533, 534, 538, 539, 206/1.5; 221/24.5, 69, 82, 83, 90, 91; 220/20, 20.5

[56] References Cited

U.S. PATENT DOCUMENTS

| | | | |
|---|---|---|---|
| 4,078,661 | 3/1978 | Thomas | 206/534 |
| 4,083,452 | 4/1978 | Rossmo | 206/534 |
| 4,164,301 | 8/1979 | Thayer | 206/534 |

*Primary Examiner*—Joseph Man-Fu Moy

*Attorney, Agent, or Firm*—Beveridge, DeGrandi & Kline

[57] ABSTRACT

A pill dispenser is disclosed which includes a container having a plurality of compartments for containing pills and which is coaxially mounted in combination with a pair of indexing members which can be aligned with selected container compartments to release the pills therein. The compartments in the container and apertures in the indexing members are so arranged as to provide controlled dispensed medication for a week or a month.

1 Claim, 23 Drawing Figures

MEDICATION DISPENSER

This is a continuation, of application Ser. No. 29,428, filed Apr. 12, 1979 now U.S. Pat. No. 4,245,742.

This invention relates to dispensers for medication such as capsules and pills.

There are several forms of medication dispensers available, particularly in the field of contraception pills but the prior art is lacking in providing medication dispensers for people who may be on several types of medication or pills everyday. One of the problems involved with a situation of this kind is that elderly people in particular tend to forget whether they have taken the last perscribed dosage and this can result in either missing a dosage or even taking two dosages instead of one.

The medication dispenser of the present invention alleviates both problems by providing a medication dispenser which provides firstly a means of selecting a compartment within the dispenser for a specific time period such as a day and secondly a further means to select portions of that compartment according to subsiduary time periods within the day such as breakfast, dinner, etc. One embodiment of the invention provides for controlled medication dispensing on a weekly basis and another embodiment provides means for controlled dispensing for a period of a month.

The dispenser has a container portion where the perscribed pills or capsules can be placed in the correct quantity in respective sections of the container, each section corresponding to a specific time period such as one of the days of the week and each of these sections is sub-divided for specific periods within the day so that the medication can be divided for the day into two or more portions. The container portion is coaxially mounted with a pair of indexing members one of which corresponds to the first time period and the second of which corresponds to the subsiduary time period. These indexing members are aligned with a selected container compartment thereby to release the medication therefrom.

A further feature of one embodiment of the present invention is to provide a medication dispenser having a lock release mechanism to thereby reduce the danger of young children gaining access to the contents of the dispenser.

According to a broad aspect, the present invention provides a medication dispenser comprising a plurality of members coaxially mounted with respect to one another and including a container having concentric rolls of compartments adapted to contain medication such as pills and capsules. A first indexing member is coaxially positioned with respect to the container and which, in response to movement between the container and the first indexing member, is capable of indexing positions which represent a series of time periods such as days in the week. An elongated opening is provided in the first indexing member for communication with at least two compartments in separate concentric rows of the container and which contains pills to be dispensed within one of the time periods. A second movable indexing members is also provided and is coaxially mounted with respect to the first indexing member and is adapted to be indexed to positions which represents subsiduary time periods such as morning, evening, within the first time periods. The second indexing member has aperatures therein which can be aligned with part of the elongated aperature in the first indexing member to give access to one of the compartments in the container. There is sufficient aperatures to communicate with the compartments in each of the separate concentric rows.

The invention is illustrated by way of example in the accompanying drawings in which.

Figure 1:
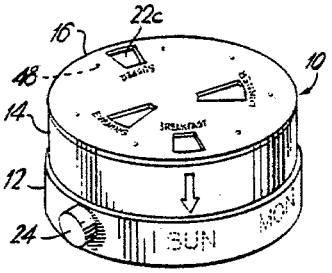
FIG. 1 is a perspective view of one embodiment of the present invention.

Referring to FIG. 1, one embodiment of a medication dispenser 10 comprises a container member 12, a first indexing member 14 coaxially mounted on the container 12 and rotatable thereon and a second indexing member 16 coaxially mounted on top of the first indexing member. As shown in FIG. 1, indexing member 14 has an aperture 18 therein and when the member 14 is rotatably dialed to a specific time period such as Sunday as shown in FIG. 1, aperture 18 is in registry with a compartment 20 in container 12. Additionally, indexing member 16 as a plurality of aperatures at 22 in the surface thereof and when indexing member 16 is rotated to correspond to a specific period in the day such as breakfast, the aperature 22 comes into registry with the aperature 18 in indexing member 14 so that a specific compartment of subcompartment is opened and the medication can be dispensed therefrom. The dispenser 10 includes a lock 24 which will be described in detail hereinafter and which, until released, can inhibit operation of the dispenser by a child.

Figure 2:
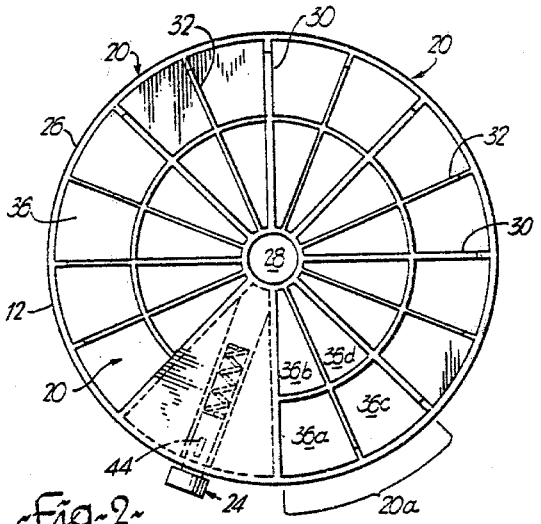
FIG. 2 is a plane view of the container portion of the embodiment of FIG. 1.
Figure 3:
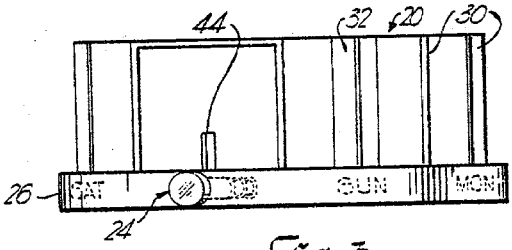
FIG. 3 is a side elevation of the compartment shown in FIG. 2.

Turning to FIGS. 2 and 3, the container 12 has a base portion 26 and a tubular central axial or hub 28 with a plurality of partitions 30 extending radially outward therefrom to divide the container 12 into seven compartments 20 each of which corresponds to a specific time period in the example illustrated this time period being a day of the week. Further radial partitions 32 intermidiate the partition 30 together with an annular partition 34, serves to sub-divide the compartments 20 into a smaller compartment 36. For example, as shown in the lower right hand portion of FIG. 2, compartment 20*a* is sub-divided into four smaller compartments 36*a* through 36*d* inclusive, these smaller compartments representing subsiduary time periods of the day within the time period of the whole day represented by compartment 20*a*.

Figure 4:
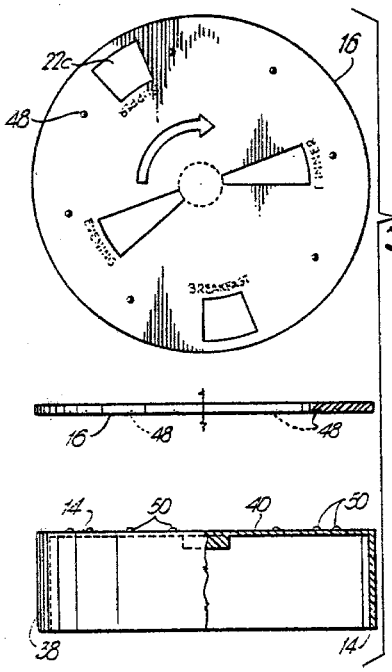
FIG. 4 is a side view of two indexing members associated with the container of FIGS. 2 and 3.
Figure 5:
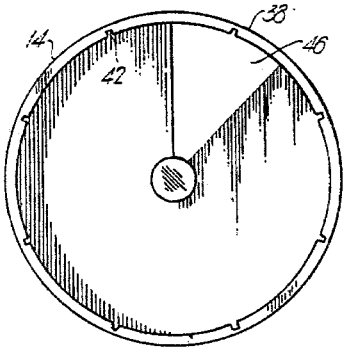
FIG. 5 is a plane view of the underside of one of the indexing members shown in FIG. 4.

Referring to FIGS. 4 and 5, the first indexing member 14 is in the form of a shallow cylinder having a continuous side wall 38 and a top wall 40. As shown in the underside view of FIG. 5, sidewall 38 has a series of notches 42 therein, each notch being positioned opposite the centre of a compartment 20 when member 14 is placed over the container 12 as in FIG. 1. Notch 42 is adapted to be engaged by a detent 44 on the locking device 24 as will be described later on.

FIG. 5 also shows that the top wall 40 of member 14 is provided with an elongated, ply shaped opening 46 which, when member 14 is rotated on container 12, will fall into registry with a selected one of the compartments 20 as described previously in relation to FIG. 1.

As shown in FIG. 1, the second indexing member 16 is in the form of a circular disk having four segment shaped aperatures 22 therein each of which correspond to one of the sub-compartments 36*a* through 36*d* of the container shown in FIG. 2. For example, aperature 22*b* corresponds to compartment 36*b* and aperature 22*c* corresponds to compartment 36*c* and so on.

It will be appreciated that indexing member 16 rotates relative to indexing member 14 and in order to maintain member 16 in a desired position with respect to member 14, member 16 is provided with a series of circumferentually spaced detents 48 which are releasibly engaged by corresponding proturberances 50 provided on the upper terminal edge of the member 14 as shown in FIG. 4. When manufactured from a plastic material, the indexing member 16 will have enough natural resiliency to overcome the frictional engagement of the proturberances 50 and detents 48 to be rotated with respect to member 14 in the desired direction.

Figure 7:
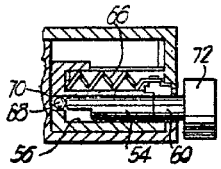
FIGS. 7 through 10 are sectional views showing various operative positions of the locking member.

The locking member 24 is the same as the locking members disclosed in my Canadian Pat. No. 1,017,292 issued Sept. 13, 1977. As shown in FIGS. 2 and 7 through 10, locking member 24 comprises a shaft 54 rotatably mounted in a bore 56, shaft 54 having a semicircular or half-cylindrical extention 58 on the terminal end thereof. The shaft 54 also supports a freely mounted collar 60 having a winged member thereon including a detent blade 62 and a spring retainer 64. As shown in FIG. 7, a coil spring 66 biases the shaft 54 to an outward position where the detent 62 engages one of the notches 42 in the walls of indexing member 14.

Figure 8:
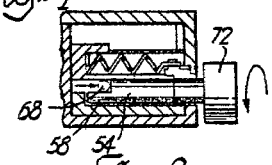
Figure 9:
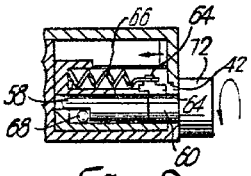
Figure 10:
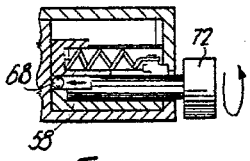

It will also be seen from FIG. 7 that the shaft extension 58 retains ball 68 in pocket 70 in the terminal end of the bore 56. In order to release the lock 24 and allow the indexing member 14 to rotate with respect to the container 12, the steps in FIGS. 8, 9 and 10 are followed. Firstly, the shaft 54 is given a half turn by its knob 72 and in conjunction with a tipping of the container 12, the ball 68 rolls out of its pocket 70 onto the relieved portion on the end of the shaft 54.

A further half turn of the shaft is shown in FIG. 9 causes the ball 68 to be dropped down into the space in the bore 56 below the pocket 70 and this allows the shaft 54 to be pushed inwardly (to the left in FIG. 9) against the pressure of spring 66 to remove the detent 62 from the notch 42 as illustrated. When the indexing member 14 is subsequently rotated, the spring 42 flips the detent 62 into the next notch 42 and another half turn on the knob 72 and shaft 54 lifts the ball 68 upwardly and redeposits it into its pocket 70 as shown in FIG. 10.

The sequence of operation of the embodiment of the invention shown in FIGS. 1 through 10 is as follows. The lock 24 is actuated to allow indexing member 14 to rotate. Rotation of member 14 brings its aperature 46 into registry with a compartment 20 and the spring 66 causes the detent 62 to engage in notch 42 in the wall of the indexing member 14, preventing further rotation thereof. For the first medication of the day, the second indexing member 16 is rotated about the top wall of the first member 14 until the notch 22 for example that labeled breakfast, is brought into registry with compartment 36*a* in the container 12. The medication in compartment 36*a* can be released. For the second and further dispersaries of the day, the indexing member 16 need only be rotated to its selected subsiduary time period within the day and the associated compartments will be opened so that the medication can be removed.

Figure 12:
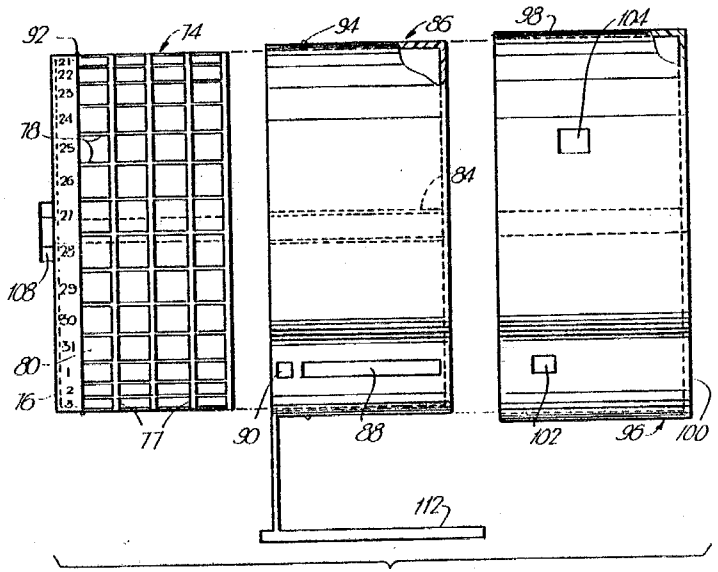
FIG. 12 is an exploded view of the container portion and indexing members of the second embodiment of the invention.
Figure 11:
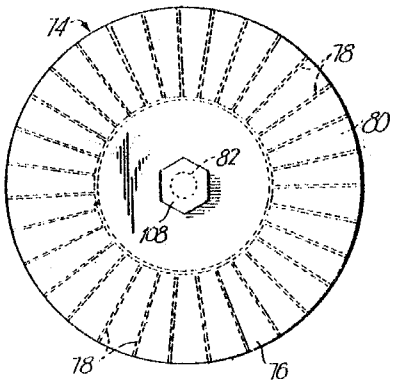
FIG. 11 is an end view of a container portion of a further embodiment of the invention.

A second embodiment of the invention provides means for controlled dispensing of medication for a one month period. Referring to FIGS. 11 and 12, the dispenser includes a container drum 74 having a wall 76 and a plurality of concentric walls 77 spaced equidistantly apart by radially extending partitions 78 to provide a plurality of concentric rows of compartments 80, all being opened to the circumference of the container drum 74. The wall 76 as shown in FIG. 11 may be provided with numerical representations of series of time periods, in this case days of the month. Accordingly, the four compartments 80 to the right of number 25 in the left hand side of FIG. 12 represents the four periods during the day of the 25th of the month in which medication will be placed and subsequently dispensed therefrom.

Drum 74 is provided with a tubular axial 82 and is adapted to receive therein a tubular axial 84 of smaller diameter on a drum shaped first indexing member 86 which receives the container drum 74 therein so that, when rotated, a series of four compartments 80 in drum 74 will be in registry with an elongated aperature 88 in the side wall of the indexing member 86. A smaller aperature 90 in alignment with the aperature 88 will reveal the particular day of the month indicated on wall 76 of the container 74. Ratchet tips 92 on the wall of the drum 74 will cooperate with depressions 94 in the indexing drum 86 to provide a frictional click-stop action between the container 74 and the indexing member 86.

Figure 13:
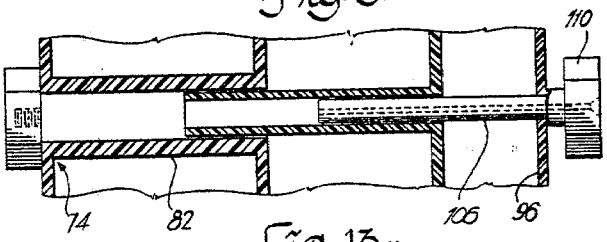
FIG. 13 is a partially exploded view in section of the axial members of the second embodiment.

A second indexing member 96 has a continuous sidewall 98 and a bottomwall 100 and the sidewall 98 is provided with a plurality of aperatures 102, 104 representing these subsiduary time periods of each day which, when the indexing member 96 is rotated will fall into registry with the first through fourth compartments 80 in the series as the aperatures 102, 104 are sequentially brought into registry with the elongated aperature 88 in the first indexing member 86. As shown in FIG. 13, the second indexing member 96 has a sub-axial 106 which is adapted to be received in the hollow axial 84 of the first indexing member 86 so that member 96 is rotatable around the outside of member 86. It will also be appreciated from FIGS. 12 and 13 that the container drum 74 is manually rotated within the indexing drum 86 by means of a control knob 108 and the indexing drum 96 is similarly rotated on the outside of drum 86.

Figure 14:
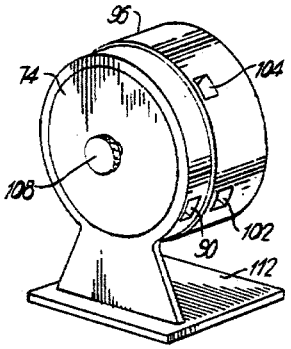
FIG. 14 is a perspective view of the second embodiment of the invention in assembled condition.
Figure 15:
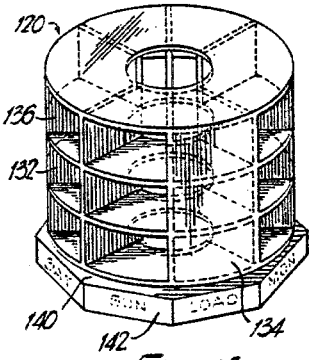
FIG. 15 is a container drum of a third embodiment of the invention.

In order to load the dispenser, the indexing drum 96 is removed from the unit and the container drum and first indexing drum 86 are laid back so that the elongated opening 88 is in an upmost position. Using the control knob 108 on the drum 74, the later is then sequentially revolved while all the compartments 80 falling under the opening 88 are filled. The drum 96 is then replaced and the assembly is ready for operation. As shown in FIG. 14, the unit can be mounted in a vertical position by providing the drum 86 with an integrally formed stand 112 whereby contents of the drum can be dispensed into a positioned paper cup or the like are required intervals.

In operation, the control knob 108 on container 74 is rotated until a selected date appears in the aperature 90 in drum 86. The indexing drum 96 is then rotated until aperature 102 in the wall of drum 96 falls into registry with the first compartment 80 under the elongated aperature 88 and the medication in that compartment can be removed therefrom. If the unit is freely mounted in the virtical position as in FIG. 14, the medication will fall by gravity on the aperature. The drum 96 is subsequently rotated at the required times of the day until all of the aperatures 80 in the row of the day in question are emptied. While a manual operation of the unit has been illustrated, a timing device could easily be attached to automatically rotated the dispenser and a minute reminding buzzer could also be incorporated into the device and in association with the timing attachment to indicate to the user that medication is being dispensed.

Figure 18:
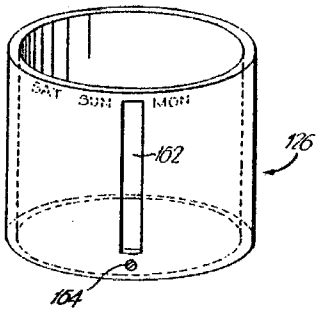
FIG. 18 is a similar view of an outside loading drum of this embodiment.
Figure 17:
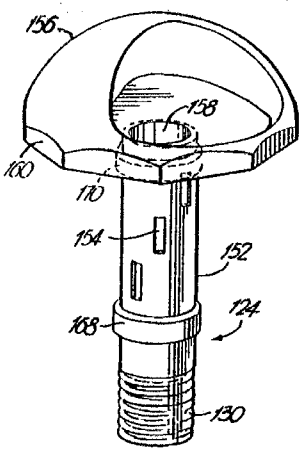
FIG. 17 is a perspective of a second indexing member in accordance with this embodiment.
Figure 19:
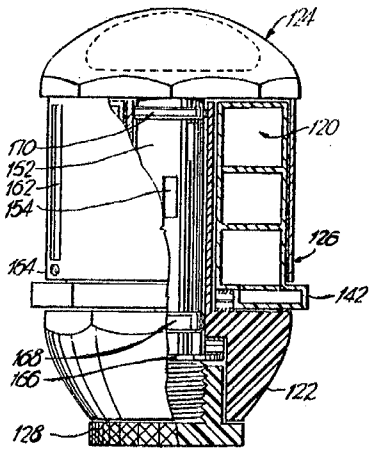
FIG. 19 is a cross-sectional view of the assembled embodiment.

The third embodiment shown in FIGS. 15 through 19 incorporates elements for dispensing medication for a week, four times per day. As shown in FIG. 19, the embodiment includes a container drum 120 mounted around a first indexing member 122 which in turn has a second indexing member 124 concentrically mounted therein, an outside loading drum 126 being concentrically positioned on the outside of the other elements. The assembly is held together by means of a large plastic or like washer 128 which has interior threads to receive exterior threads 130 on the lower end of the second indexing member 124. It will be appreciated from FIG. 19 that elements 120, 122, 124 and 126 can move relative to one another to align various apertures therein for dispensing medication. Container drum 120 is provided with seven radial sections 132 corresponding to days of the week plus a blanked off section 134 for positioning of the loading drum 126. The radial sections 132 are divided into four separate compartments 136 as shown. The lower portion of the drum 120 is provided with a peripheral rim or flange 140 having a series of flat portions 142 thereon and on which would be indicated the days of the week.

Figure 16:
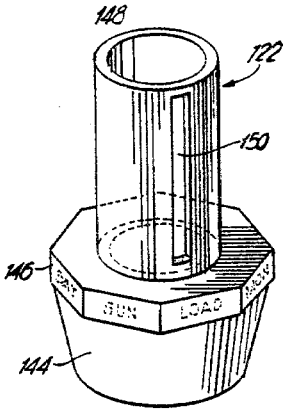
FIG. 16 is a perspective view of a first indexing member of the embodiment shown in FIG. 15.
Figure 6:
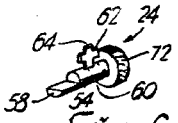
FIG. 6 is a perspective view of a locking member.

As shown on FIG. 16, the first indexing member has a lower base portion 144 having a series of flats 146 corresponding to the flat portions 142 on the container drum 120. An elongated tubular member 148 extends upwardly from the base 146 and is provided with a vertical slot 150 for alignment with a vertical row 136 of compartments in the container drum 120.

The second indexing member 124 is adapted, as shown in FIG. 19, to operate within the tubular member 148 in the first indexing member and in that regard, the second indexing member 124 has an elongated tubular member 152 having a series of openings 154 in the wall thereof and the lower end of the portion 152 includes the threads 130 for the purpose mentioned earlier. The top of the member 124 is provided with a semispherical member 156 having a central opening 158 and again a series of flats 160 around the peripheral edge thereof for easy gripping by hand. Additionally, the specific meal indicator such as breakfast, lunch, dinner, etc. is marked on the periphery of the member 156. The periphery of the top also extends out over the outside loading drum 126 which is provided with a vertical elongated opening 162 and a set screw 164.

In order to load the device, the set screw 164 is loosened off and the opening 162 is moved into registration with the first series of compartments 136 (for example Monday) in the container drum and medication is loaded into each individual compartment in that row. The loading drum is subsequently moved around to each series of rows in the container drum and the loading is completed. The opening 162 in the loading drum is then moved to the blanked portion 134 of the container drum and is secured at that point by the set screw 164. For medication to be dispensed, the user would grasp the bottom of the first indexing member 144 in one hand and turn the container drum 120 with the other hand one notch so that the date required, such as Monday would line up with the date indicator on the flat 146 of the first indexing member 144. Using the second indexing member and the apertures 154 therein, allows access to one complete days medication in the row of compartments 132 thereof by lining up the meal desired on the second indexing member 124. This allows the medication to fall into the center of the member 124 and out through the top aperture 158 when the unit is tipped.

Referring to FIG. 19, the nut 128 is provided with a washer 166 which seats against a raised area of flange 168 on the wall of the tubular portion 152. A similar raised portion 170 is provided at the top thereof. A ratchet means 172 can be provided in the areas indicated.

Figure 20:
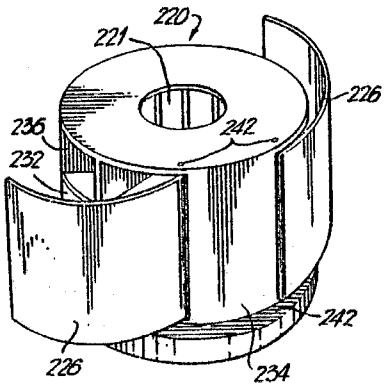
FIG. 20 is a perspective view of a container drum.

Referring to FIG. 20, a container drum 220 has a plurality of vertically arranged sections 236, one for each day of the week, each section having a series of compartments 232 corresponding to periods of a day when medication is desired. As in the FIG. 15 embodiment, section 234 may be blanked off as shown or, if open, a separate cover may be provided.

In place of the loading drum 126 of FIG. 18, the present embodiment uses a pair of semi-circular doors 226 pivotally mounted to upper and lower flanges of the container drum 220 by pins 242. The doors can be opened fully to expose the interiors of the compartments 232 for loading the same.

Figure 21:
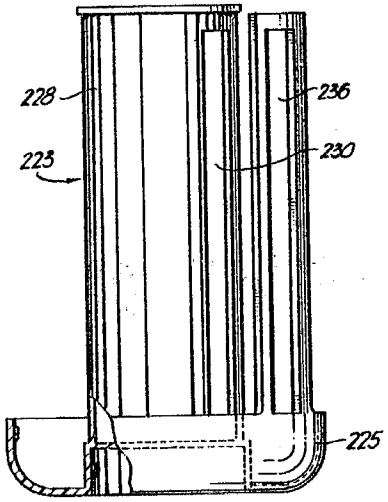
FIG. 21 is a perspective view of a first indexing member.

In FIG. 21, a first indexing member 223 is shown having a base 225 and a central, elongated tubular member 228 with a vertical slot 230 therein which will register with the inner ends of the compartments 232 in the container drum 220. A rectangular frame 236 is provided on the outer edge of base 226 for "framing" the day indicated on the outer door of the container drum 220. The tubular member 228 of the indexing member 223 fits freely within the central aperture 221 of the container drum 220 so that they rotate smoothly with respect to one another.

Figure 22:
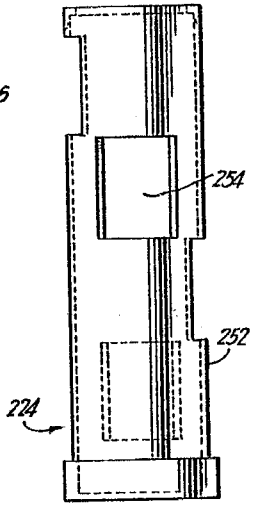
FIG. 22 is a perspective view of the second indexing member.

FIG. 22 shows the second indexing member 224 adapted to fit within the tubular member of the first indexing means 223 and to this end is provided with a tubular body 252 having a series of circumferentially spaced openings 254 therein adapted to register with the various compartments 232 in each section 236 of the container drum 220 through the slot 230 in member 223.

Figure 23:
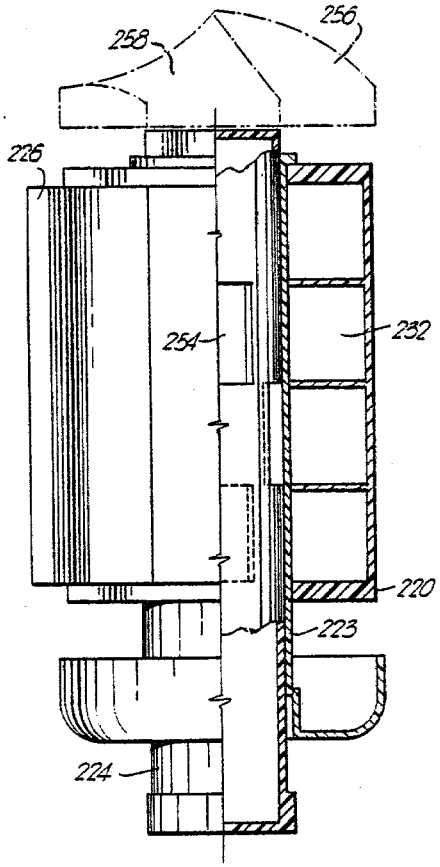
FIG. 23 is a cross-sectional view of the assembly.

Referring to FIG. 23, the assembly of the medication dispenser is illustrated in a manner similar to FIG. 19 of the previous embodiment. It will be seen that the second indexing member 224 is slidably received within the tubular body of the first indexing member 223 which in turn receives the container drum 220 thereon. The upper end of the second indexing member 224 is provided with a cap 256 similar to the cap 156 in FIG. 17 and which is provided with a central opening 258 which registers with the confines of the tubular members in the indexing members 223 and 224.

The present embodiment is loaded as previously mentioned by opening the doors 226 and filling the compartments 232 with the desired amount of medication. The doors are then closed and the first indexing member is rotated until its' frame 236 covers the day of the week on which medication is being taken, for example, Monday. In this location, the slot 230 in the first indexing member is in registry with the inner ends of the vertical row 236 of compartments 232. A second indexing member is then rotated to that period of the day in which medication is being taken, such as breakfast, so that one of its' openings 254 is in registry with a single one of the compartments 232 through the slot 230 in the first indexing member. The container can be moved so that the medication will drop through the openings in the indexing member and out through the opening 258 in the cap 256.

While the invention is being described in connection with specific embodiments thereof and specific uses, various modifications thereof will occur to those skilled in the art without departing from the spirit and scope of the invention as set forth in the appended claims.

The terms and expressions which have been employed in this disclosure are used as terms of description and not of limitation and there is not intention in the use of such terms and expressions to exclude any equivalents of the features shown and described or portions thereof, and it is recognized that various modifications are possible within the scope of the invention as claimed.

I claim:

1. A medication dispenser comprising a plurality of members coaxially mounted with respect to one another and including a container having at least three circular rows of compartments adapted to contain medication;

a first indexing member coaxially positioned with respect to the container and which, in response to movement between the container and the first indexing member, is capable of indexing positions that are representative of a series of time periods, an elongated opening in the first indexing member for communication with a plurality of aligned compartments in said circular rows of the container and which contain medication to be dispensed within one of such time periods;

and a second movable indexing member coaxially mounted with respect to the first indexing member and adapted to be indexed to positions representing subsidiary time periods with the first-mentioned time periods and apertures in the second indexing member which, by rotation of the second indexing member, can be placed into registry with part of the elongated aperture in the first indexing member to give access to one of the compartments in the container; there being sufficient apertures in the second indexing member to communicate with the compartments in each of the rows;

said container comprising a circular member having a plurality of coaxially arranged circular walls spaced from one another by radially extending partitions to define a plurality of compartments;

and a central longitudinally extending tubular opening in the container, the compartments having inner ends communicating with said tubular opening.

* * * * *